US007028355B2

(12) United States Patent
Koga

(10) Patent No.: US 7,028,355 B2
(45) Date of Patent: Apr. 18, 2006

(54) MEDICAL SANITARY MULTIFUNCTIONAL SYSTEM BED

(76) Inventor: Masateru Koga, 6-12-201, 2130 Yamazaki-cho, Machida-shi, Tokyo (JP)

( * ) Notice: Subject to any disclaimer, the term of this patent is extended or adjusted under 35 U.S.C. 154(b) by 0 days.

(21) Appl. No.: 10/739,335

(22) Filed: Dec. 19, 2003

(65) Prior Publication Data

US 2005/0132494 A1 Jun. 23, 2005

(51) Int. Cl.
*A61G 9/00* (2006.01)

(52) U.S. Cl. ..... 5/606; 5/604; 5/609; 5/928; 4/547

(58) Field of Classification Search ..... 5/604–606, 5/609, 695, 900, 928; 4/547
See application file for complete search history.

(56) References Cited

U.S. PATENT DOCUMENTS 3,434,165 A * 3/1969 Keane ..... 5/608
3,757,355 A * 9/1973 Allen et al. ..... 5/604
5,077,845 A * 1/1992 Tokunaga et al. ..... 5/605
5,230,113 A * 7/1993 Foster et al. ..... 5/608
5,604,943 A * 2/1997 Kimura et al. ..... 5/604
5,729,848 A * 3/1998 Yamagishi ..... 5/606
5,729,849 A * 3/1998 Garakani ..... 5/618

* cited by examiner

*Primary Examiner*—Michael Trettel
(74) *Attorney, Agent, or Firm*—Paul A. Guss

(57) ABSTRACT

A medical sanitary multifunctional system bed is provided for nursing, having necessary functions that can be added optionally according to clinical conditions of users. The optional addition of functions allows the medical sanitary multifunctional system bed to perform necessary functions, on a case-by-case basis, thereby minimizing the economic burden imposed on patients. Ordinarily, the bed includes a lower capsule, supported by a metallic support frame, an upper capsule mounted on the lower capsule, a movable and rotatable portion, which is supported by the metallic support frame, and a plurality of removable cushions placed on the movable portion. On a optional basis, the bed may include a stool, a bathtub, a shower, and additional washers.

6 Claims, 15 Drawing Sheets

MEDICAL SANITARY MULTIFUNCTIONAL SYSTEM BED

BACKGROUND OF THE INVENTION

Description of the Prior Art

As widely known, there is a need for nursing and for attending to persons when such persons suffer from diseases or become too serious in condition to move about freely. To respond to this need, beds for nursing have been provided substantially with convenient functions for facilitating the nursing of patients. Representative functions so far developed for nursing beds are, for example, frame bodies that are used for fixing patients to help them turn on their sides in bed, tables used for meals, toilets to be set under the bed frame, and washing facilities or the like. Shower sets and bath sets are also functions that are very helpful for patients who are so feeble as to be confined to bed.

However, unfortunately, nursing beds having such convenient functions have been very costly unavoidably, because such beds are produced only in small lots, and furthermore, prices for such beds inevitably become higher in order to accommodate the types of functions included. Hence, as more functions are provided, such nursing beds often become so high in price that they cannot be purchased by those who truly wish to use them.

It should be noted that clinical conditions vary widely among patients in need of nursing beds and, in most cases, the functions needed are different among individuals. However, in conventional nursing beds, the types of functions included cannot be specified in detail, and desired functions cannot be used unless functions that are not needed to be used are paid for as well.

For example, a toilet set that is disposed underneath the bed is not needed before a patient becomes confined to bed, and such a function is unnecessary for patients who are able to walk to the toilet. Likewise, shower sets, bath sets and the like are sure to provide useful functions, however, at present, such functions are purchased considering their expected use at some point in the future, rather than based on a need for current use. Thus, up to the present, in some cases, payments even for unnecessary functions must be made, however reluctantly.

SUMMARY OF THE INVENTION

The present invention has been made in light of the problems mentioned above, wherein an object of the invention is to provide a nursing bed in which all necessary functions therefor are made available by adding such functions in a modular fashion, in accordance with the clinical conditions of the patient, thereby enabling the bed to be provided at the lowest possible cost.

The above object of the present invention is achieved by a medical sanitary multifunctional system bed, which provides various functions that are effective for the nursing of patients whose own bodies cannot move easily and freely, such as fairly aged persons who are so feeble as to be confined to bed and the like. The multifunctional system bed comprises a body, which is constituted of a lower bed portion for supporting the lower half body of a user, a waist bed portion for supporting the center part of the user, and an upper half body supporting upper bed portion for supporting the upper half body of the user. The body of the bed is rotatably mounted on a bed base, and is arranged so as to allow the mounting of an upper hot water washer at the upper bed portion for supporting the upper half body, as well as mounting of a lower hot water washer and a lower flush toilet to be disposed under the waist bed portion, and mounting of an upper half body support member, which is used for changing the position of the user on the upper half body supporting bed portion.

On the other hand, a part of the bed cushion, which is disposed at the waist bed portion, is removable, so that the lower hot water washer and the lower flush toilet can be exposed to enable full use of the flush toilet.

The medical sanitary multifunctional system bed has several other features. The flush toilet may include a crushing means, comprising a crushing cutter and a motor, serving as a crushing means for crushing and discharging excrement from the user. Further, the body of the bed is rotatably mounted through a rotating support shaft, and is made rotatable by a specified angle in a specified direction, by means of a rotation controller. Still further, a water tank is provided to store hot water, which is supplied to the upper and lower hot water washers, while a cord heater is wound around a hose for the supply of hot water, wherein the hot water stored in the water tank is supplied thereby to the upper and lower hot water washers.

As a result of the techniques and means of the present invention, as mentioned above, it is possible to provide a bed for nursing, which has only those functions that are needed for patients and fairly aged persons who use the bed, and thus the bed itself can be supplied at a lower cost.

DETAILED DESCRIPTION OF THE INVENTION

Preferred embodiments according to the present invention shall be described in detail below, with reference to accompanying drawings.

Figure 1:
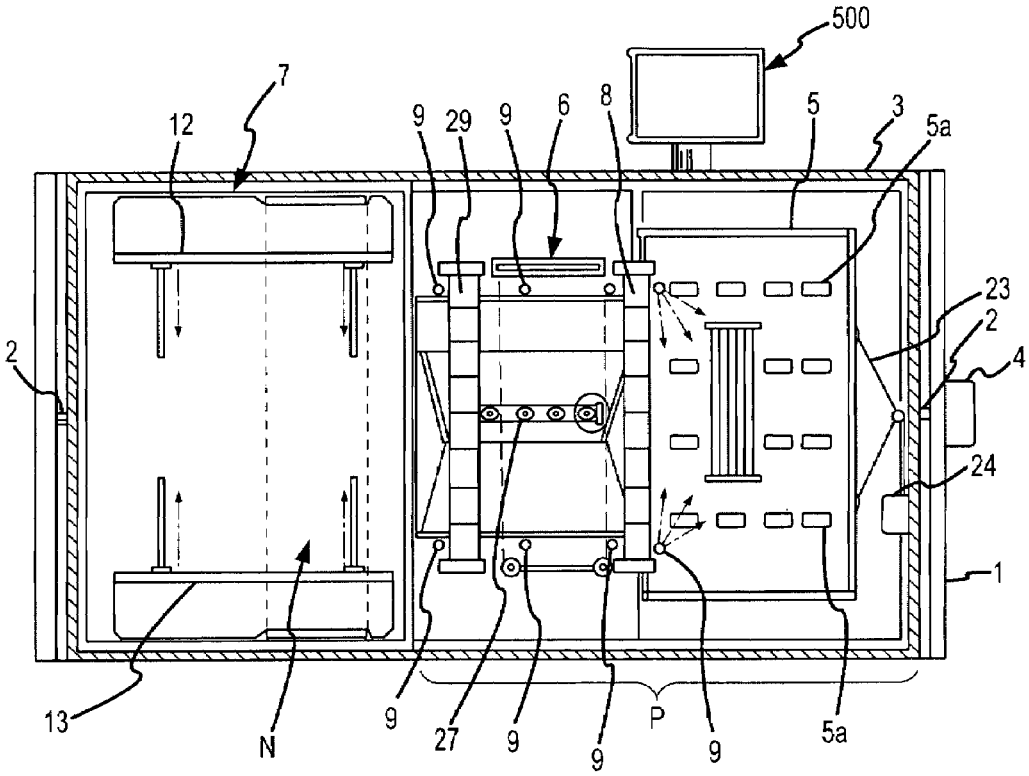
FIG. 1 shows a general plan view showing an embodiment according to the present invention.
Figure 2:
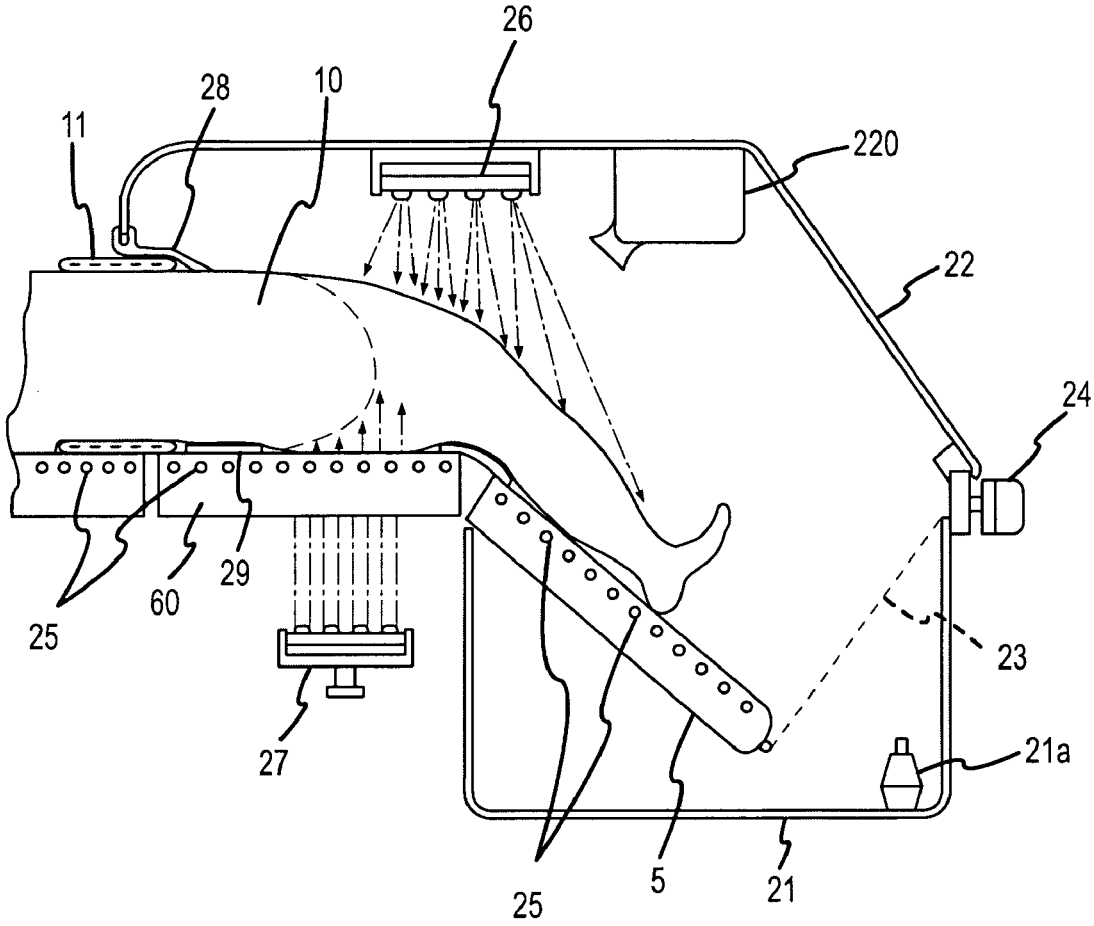
FIG. 2 is a view illustrating a portion P of the view shown in FIG. 1.
Figure 3:
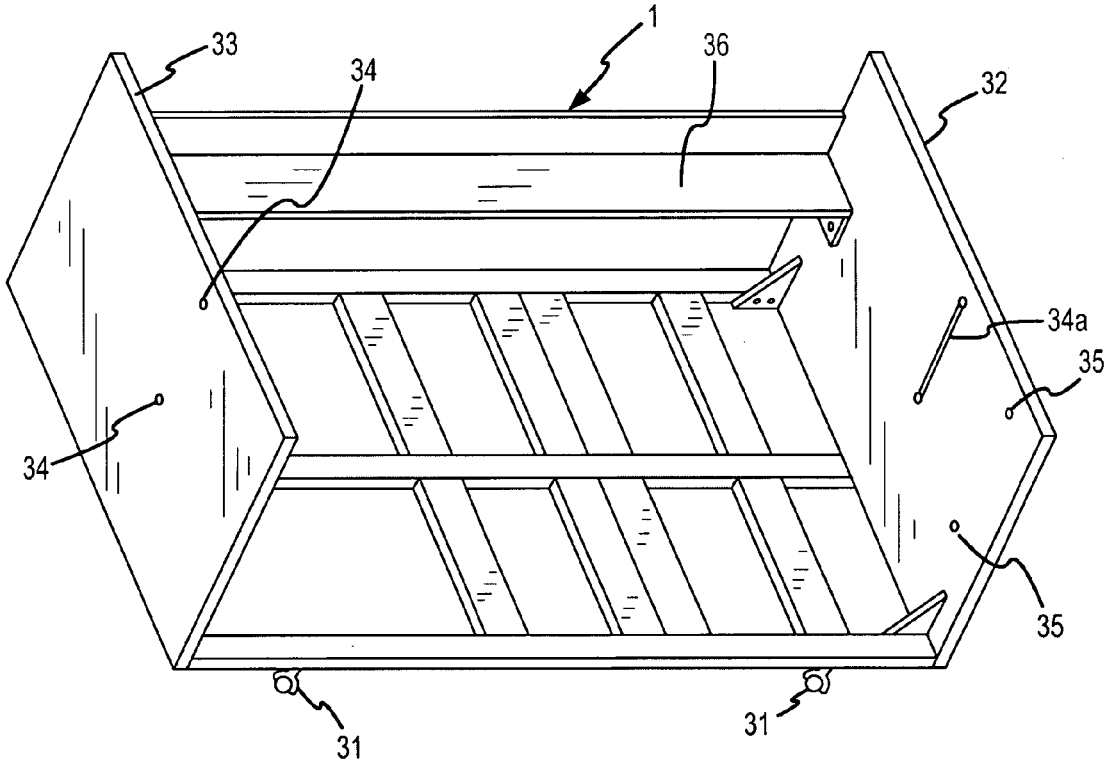
FIG. 3 is a perspective view showing an example of a bed base.

Referring first to FIG. 1, FIG. 2 and FIG. 3, two hinge holes 34 for rotatably supporting a rotation support shaft 2 are provided vertically at each of center parts on both sides of a bed base 1. A hinge 34*a* is mounted on the hinge holes 34, wherein a rotation controller 4 is provided for the hinge 34*a*. The body 3 of the bed is mounted on the bed base 1. In the following embodiments, the rotation controller 4 comprises a motor, wherein a reduction gear or the like is provided to accomplish rotation of the body 3 of the bed, without requiring application of large forces. The position of the rotation controller 4 mounted on the hinge 34*a* can be selected vertically, thereby allowing the height position of the body 3 of the bed to be set freely. For example, the position may be lowered during normal operations, and during use of the flush toilet, the position of the bed may be raised for the user confined to the bed, thereby significantly improving the handling of the body 3 of the bed.

In the disclosed embodiments, the bed base 1 is provided with a string-hoisted bed portion 5, a waist bed portion 6, an upper half body supporting bed portion 7, and the like, wherein the waist bed portion 6 and the string-hoisted bed portion 5 are made foldable mutually, and connected with a bed connection cover 8, which prevents the user's body from getting caught in the folded portion when the string-hoisted bed portion 5 is lifted or lowered. In FIG. 1, the string-hoisted bed portion 5 and the waist bed portion 6, which are shown as forming a zone P, are divided to enable the lower half body of the user to be washed, as illustrated by a side view of FIG. 2. A lower water tank 21, an upper lid body 22, a hoisting string 23, a hoisting motor 24, with a string for lifting or lowering the string-hoisted bed portion 5, and the like, are also provided. Several drainage holes 5*a* also are formed in the string-hoisted bed portion 5.

As shown in FIG. 2, a cord heater 25 is arranged for the cushion 60 of the waist bed portion 6, for keeping the user 10 moderately warm, so that the body of the user 10, after becoming wetted under washing, can be dried completely. An air heater 220 is mounted on an upper lid body 22, to enable the body, after becoming wetted by use of an upper hot water washer 26, to be dried. The cushion 60 of the bed also can be dried by the above-mentioned methods and, for example, the cushion 60 may be freely detachable, through use of Velcro or the like, thereby enabling quick replacement of a wet cushion 60 with a dry one.

An upper hot water washer 26 is mounted on the upper lid body 22, and a lower hot water washer 27 is mounted below the position of the hip of the user 10. In the disclosed embodiments, an example of a one-side opened arrangement of the cushion is shown. The body of the user 10 is washed by discharging hot water onto the user 10, in a shower, from the upper and lower hot water washers 26 and 27. A water shielding cover 28 is mounted at an end part of the upper lid body 22, to prevent hot water from scattering over the upper half body of the user 10, while the lower half body is being washed. The water shielding cover 28 is formed out of a rubber or a vinyl-based synthetic resin. In FIG. 2, an example is shown of a cord heater-applied belly-band 11, which is mounted on the belly of the user 10, to keep the user 10 warm while shielding the belly portion of the user from water. In order to support the body of the user 10 while the lower portion is opened, as shown, a waist support belt 29 is disposed on the waist bed portion 6 of the bed.

To drain the water that has accumulated in the bottom part of the lower water tank 21, an underwater pump 21*a* is provided. Accordingly, when hot water discharged onto the user 10 from the upper hot water washer 26 accumulates in the lower water tank 21, the water is pumped and drained via an underwater pump 21*a*, to prevent overflowing of water from the lower water tank 21, which might otherwise cause the inside of the room where the bed is placed to become wet.

As shown in FIG. 1, a plurality of upper bed washing nozzles 9 are arranged for washing portions between the user 10 and the waist bed portion 6. None of these need to be used, except when the user 10 becomes so feeble as to be confined to bed.

Both on the left and right sides of the upper half body supporting bed portion 7, upper half body supporting structures 12 and 13 are disposed, which are slidable to approach each other, so as to match the size of the user 10. When the upper half body supporting structures 12 and 13 are used in accordance with the present embodiment, the upper half body supporting structures 12 and 13 are fixed at specified positions determined to match the width of the body. Then, with a blanket or the like thereon, the user 10 is fastened onto the bed with a belt so that the user 10 is supported and kept from falling from the bed when the bed is inclined, to prevent possible bedsores from occurring.

Various types of beds may be considered, one example of which is shown in FIG. 3. As illustrated in FIG. 3, the bed base 1 has casters 31, mounted at a lower part thereof, for facilitating movement of the bed.

As previously stated, upper and lower vertical plates 32 and 33 are provided respectively with hinge holes 34, which are used for moving the rotating support shaft 2 vertically when the bed is rotated. A lock hole 35 for fixing the bed is formed in the upper vertical plate 32. An auxiliary bed portion 36 is attached on one side, along the length of the bed base 1, in order to increase the effective bed width when the bed is not rotated.

Figure 4:
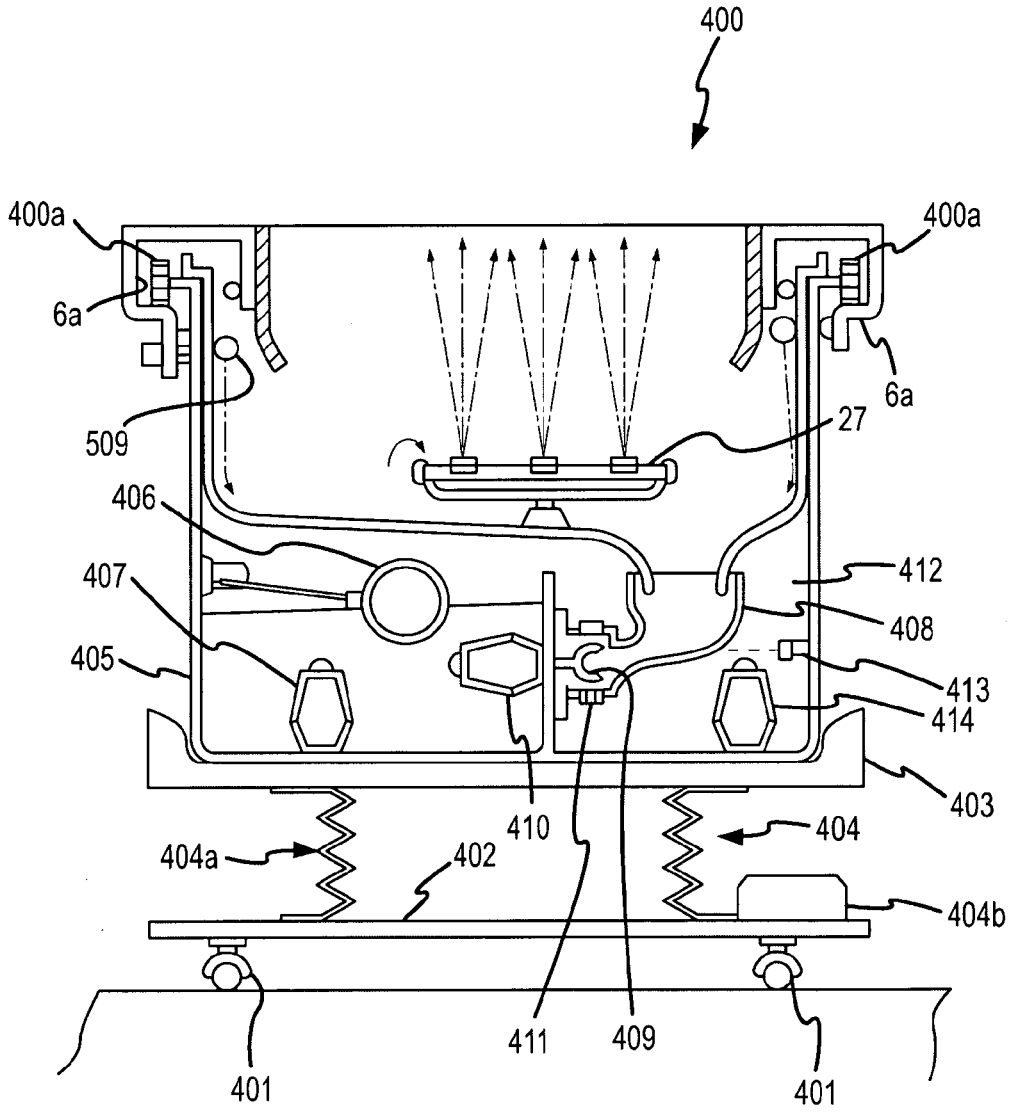
FIG. 4 is a sectional view showing an example of a lower flush toilet to be disposed under a waist bed portion.

Referring to FIG. 4, a lower flush toilet 400 shall be described. The lower flush toilet 400 is disposed under the waist bed portion 6 of the bed, as shown in FIG. 1. At the lower end part thereof, a rotary roller 400*a* is disposed within an engaging part 6*a* provided on the waist bed portion 6, in order to guide the lower flush toilet 400 to a specified position underneath the waist bed portion 6.

On the other hand, casters 401 for facilitating movement of the lower flush toilet 400 are disposed on the underside of a base plate 402, which is provided at a lower part of the lower flush toilet 400, in order to allow it to be pulled out easily from underneath the waist bed portion 6 during cleaning or repairing. A support base 403 is mounted on the base plate 402 through an air support mechanism 404, which is provided to support the weight of an upper washing water tank 405 when the tank 405 is filled with water. In the present embodiment, the air support mechanism is illustrated as being constituted of a bellows 404*a* and a compressor 404*b*.

A ball tap 406 is mounted in the washing water tank 405, which moves vertically depending on washing water stored in the washing water tank 405, so that water is supplied into the washing water tank 405 from a water supply pipe according to the position thereof. The washing water stored in the washing water tank 405 is pumped using an underwater pump 407, so as to be supplied into the lower hot water washer 27.

On the other hand, a crushing chamber 408 is provided, which receives the hot water discharged from the lower hot water washer 27, together with excrement discharged from the user 10. A crushing cutter 409 is disposed to crush solid matter while the solid matter is rotated by the motor 410 of the crushing chamber 408. Filth that is crushed by the crushing cutter 409 is accumulated in a sewage chamber 412, wherein the filth passes through a dirt filter 411 disposed at a lower end portion of the crushing chamber 408. When the liquid in the sewage chamber 412 reaches a specified level, the level is detected by a float switch 413. More specifically, when the float switch 413 detects that the level has reached the specified level, an underwater pump 414 is activated to discharge the sewage to the outside.

Figure 5:
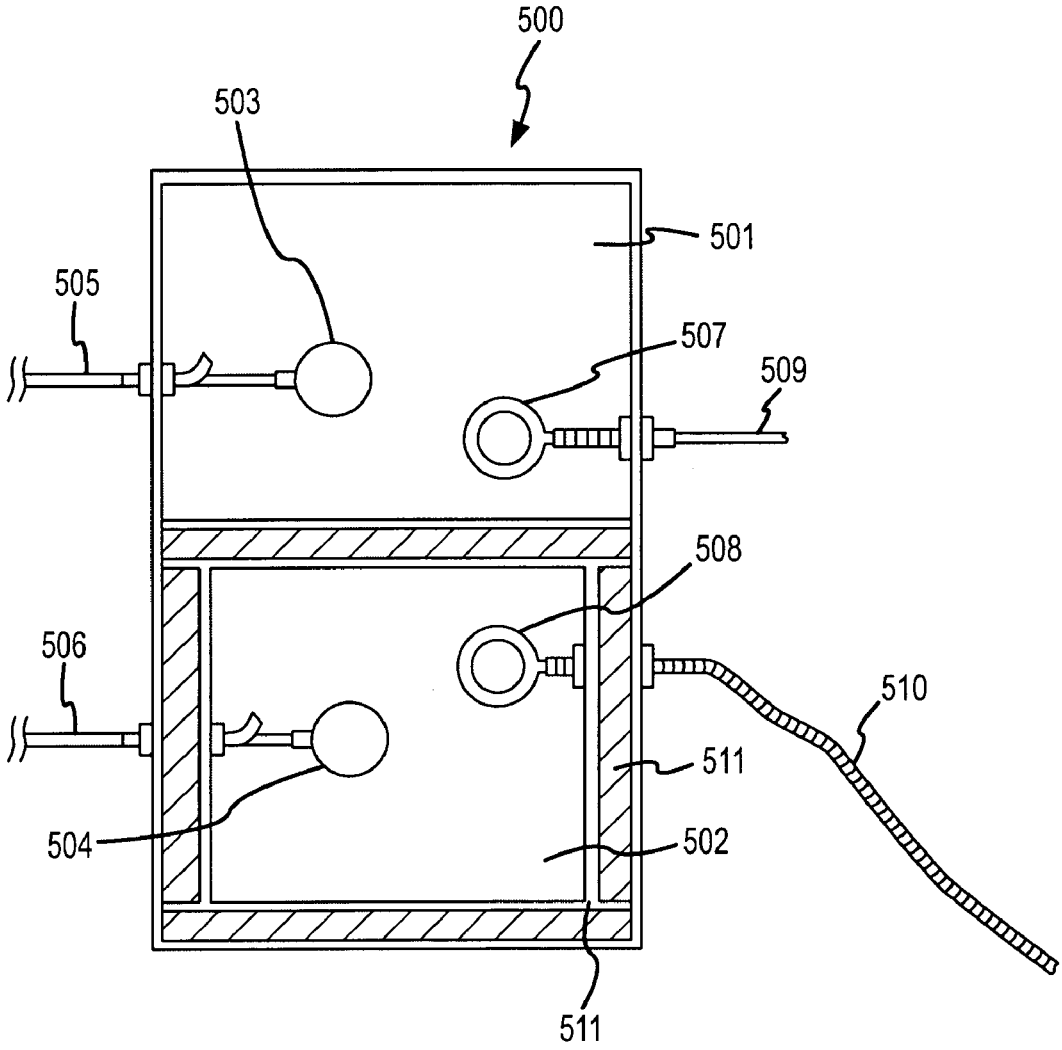
FIG. 5 is a sectional view showing an example of a water tank.

Referring to FIG. 5, a water tank 500 shall be described. The water tank 500 in accordance with the present embodiments is built of a resin or steel material, and includes a cold water layer 501 and a hot water layer 502. Ball taps 503 and 504 are arranged respectively in the cold water layer 501 and the hot water layer 502, which restrict the cold water and the hot water supplied through water resistant hoses 505 and 506 so as to reach specified levels. Underwater pumps 507 and 508 are arranged respectively in the cold water layer 501 and the hot water layer 502. The underwater pump 507 in the cold water layer 501 supplies cold water to the lower flush toilet 400 through a hose 509, so that the cold water may be used for washing the accumulated filth. Hot water, which is pumped by the underwater pump 508, is supplied to the hot water washers 26 and 27 through a hose 510 that supplies the hot water. According to the present embodiments, utilization of hot water is handled separately from the utilization of cold water, in order to prevent useless consumption of hot water, thereby reducing required expenses. The underwater pump 508 disposed in the hot water layer 502 supplies the hot water to the upper and lower hot water washers 26 and 27 through the hot water supply hose 510, which is wound with a cord heater. In the present embodiments, a heat insulating material is arranged on the wall surfaces of the hot water layer 502, while hot water is supplied through the hot water supply hose 510 that is wound with the cord heater, so that the hot water is prevented from cooling while inside the hot water supply hose 510.

Thus, hot water can be supplied while being kept hot constantly during operation, to prevent problems caused by cooling of the hot water while inside the hot water supply hose 510, when hot water is supplied to the user 10.

Figure 6:
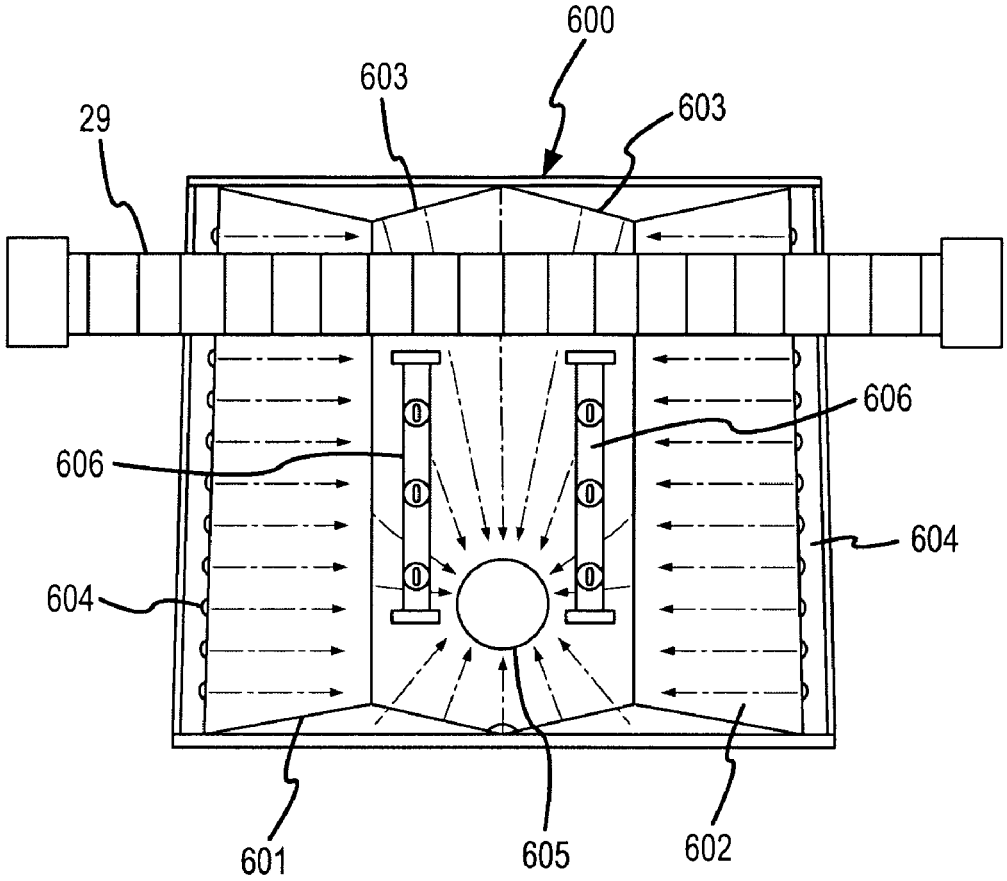
FIG. 6 is a view showing an example of the waist bed portion properly changed in form.

Referring to FIG. 6, an example of the waist bed portion 6, shown properly changed in form, shall be described. A waist bed 600 is arranged with cushions 601 and 602 that open both to the left and right. Opening or closing of the cushions 601 and 602 is performed by an opening-closing control string 603, which is pulled by rotation of a motor (not illustrated), in order to move the cushions to a normal position, at which the user lies on his side, or to a position in which the cushions serve as a toilet seat for discharging excrement. To wash the surfaces of the cushions 601 and 602, hot water pipes 604 are arranged along both left and right sides thereof, and hot water flowing out of the hot water pipes 604 runs along the surfaces of the left and right cushions 601 and 602, as indicated by the dotted lines in FIG. 6. The cushions 601 and 602 are constructed by placing the cushions, which may contain a heater for warming the cushions, on a stainless plate or a hard synthetic resin. In the example shown in FIG. 6, a lower washer 606 is arranged in a divided form, on left and right sides of a crushing chamber 605. Hot water, which is discharged from the lower washer 606 and washes the user, is guided into the crushing chamber 605.

Figure 7:
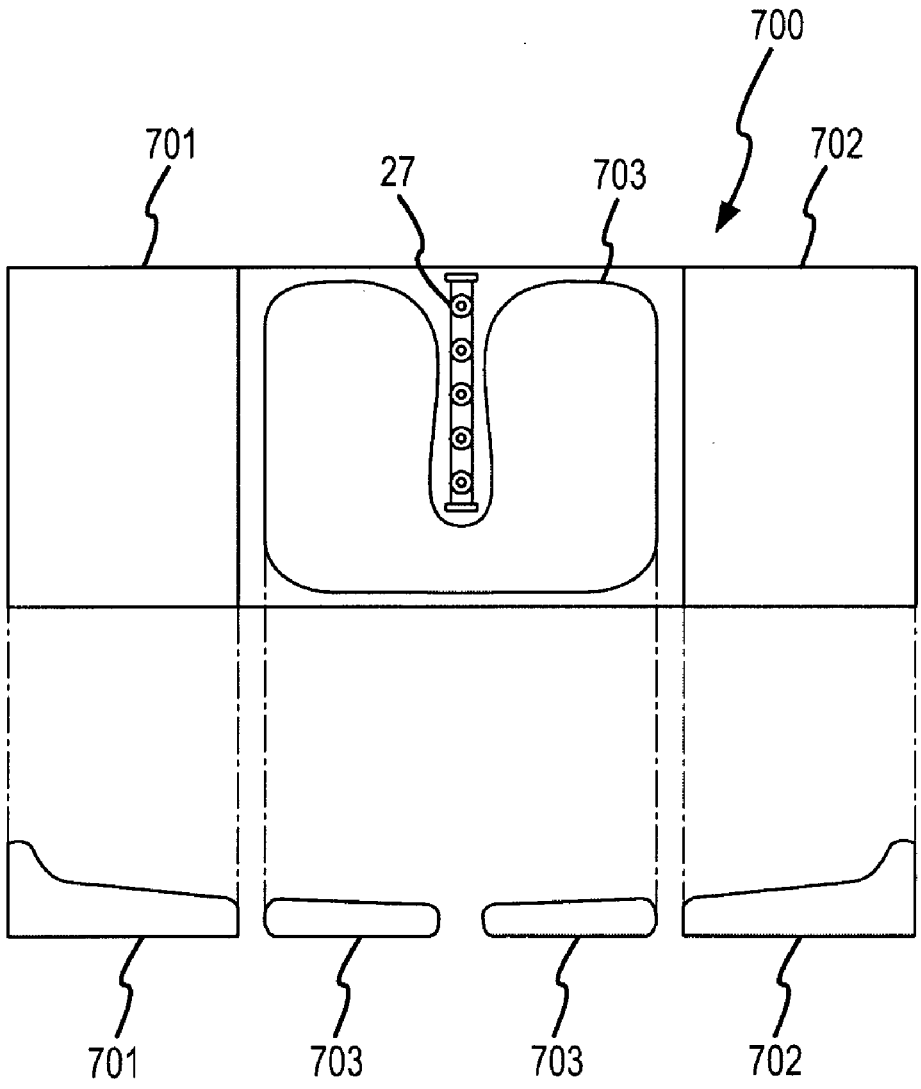
FIG. 7 is another view showing an example of the waist bed portion properly changed in form.

FIG. 7 shows another example of the waist bed portion 6, properly changed in form. A waist bed 700 has left and right cushions 701 and 702 arranged on the left and right areas thereof, and a body waist/hip cushion 703 is disposed between the left and right cushions 701 and 702. The body waist/hip cushion 703 is formed into a shape that supports the hip portion of the user 10 when the user sits thereon. The body waist/hip cushion 703 is further cut off at a central part thereof, in order to facilitate washing of localized portions of the user's body, by hot water discharged from the lower hot water washer 27.

Figure 8:
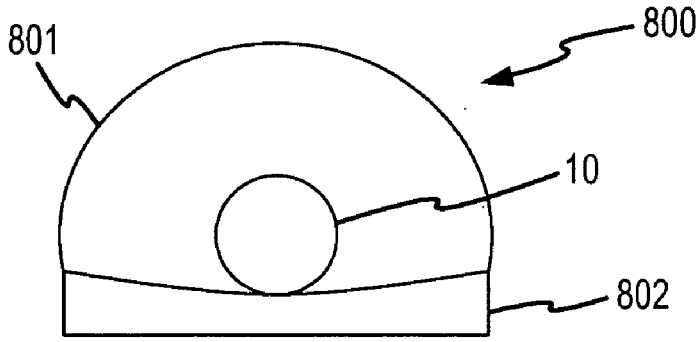
FIG. 8 is a view showing an example of an upper lid body portion properly changed in form.

Referring to FIG. 8, an example of the upper lid body 22, properly changed in form, shall be described. FIG. 8 shows an example in which an upper lid body 800 comprises a capsule formed in a semicircle, which surrounds the waist portion of the user 10 who is arranged on the bed 802. The bed 802 is built higher than a central part thereof on both sides, so that water dropped onto the bed gathers in the central part, and runs downward from the central part.

Figure 9:
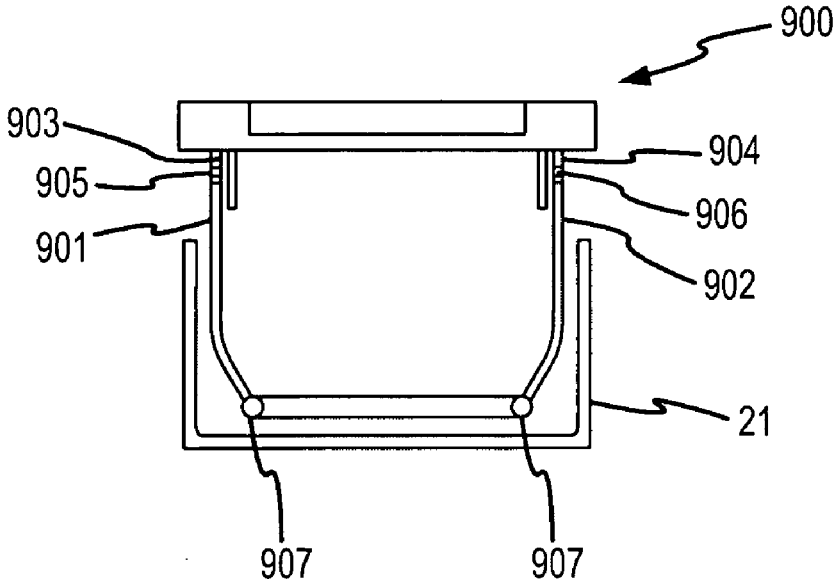
FIG. 9 is a view showing an example of a lower bed portion properly changed in form.

FIG. 9 shows an example of the lower part of the string-hoisting bed 5, properly changed in form. As shown in FIG. 9, in the present example curtains 901 and 902 for preventing scattering of water are disposed on both left and right sides on the underside of a bed 900. The curtains 901 and 902 are detachably mounted on protruded pieces 903 and 904, which project downwardly from both left and right sides on the underside of the bed 900, through fasteners 905 and 906. The curtains 901 and 902 can be removed freely, for cleaning under the bed 900.

Strings 907 are mounted respectively at lower end parts of the curtains 901 and 902, in order to regulate the interval between the curtains 901 and 902 using the strings 907, while preventing the curtains 901 and 902 from becoming stuck on or adhered to the lower water tank 21.

Figure 10:
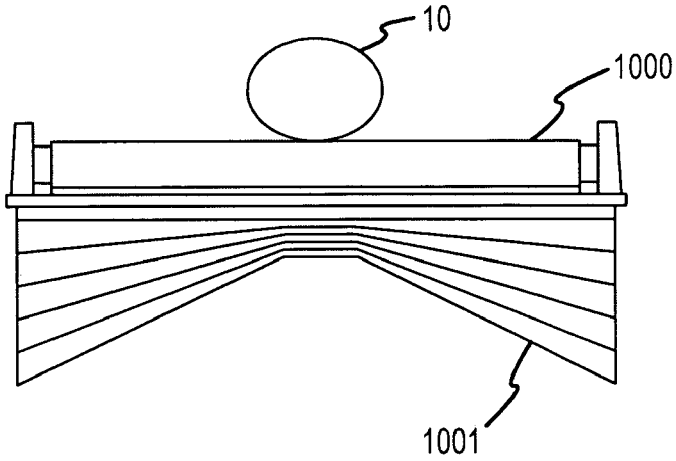
FIG. 10 is another view showing an example of the lower bed portion properly changed in form.

FIG. 10 shows an example of a connection between a bed 1000 and the lower water tank 21 (not illustrated). In this example, a bellows type curtain 1001, for preventing the scattering of water, is disposed on the underside of the bed 1000. In the case of the present example, water dropping from the bed 1000 is prevented from scattering into the room, and is gathered accurately and efficiently in the lower water tank 21.

Figure 11:
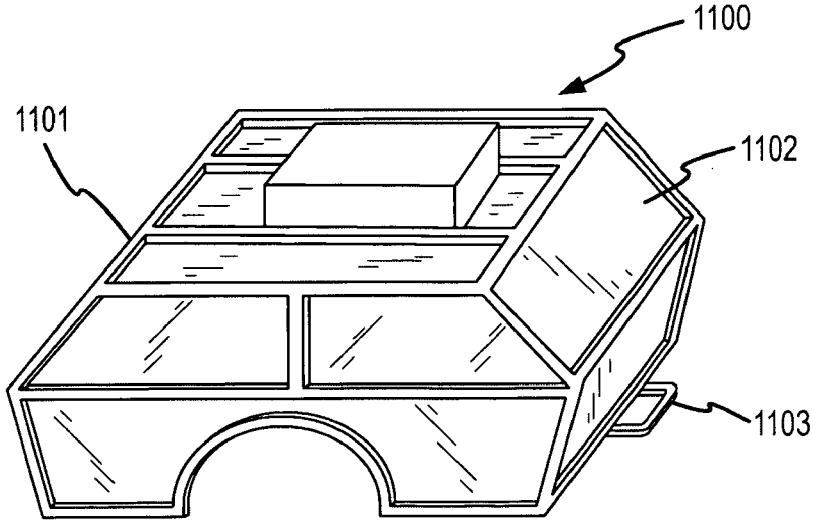
FIG. 11 is a perspective view showing another example of the upper lid body portion properly changed in form.

Referring to FIG. 11, an example of the upper lid body 22, properly changed in form, shall be described. According to the present example, an upper lid body 1100 comprises a box-like framework 1101, built of steel or the like, and a transparent body 1102 made of a synthetic resin disposed thereon. One side end of the transparent body 1102 is mounted on the bed through a hinge mechanism (not illustrated), while a knob 1103 is mounted on the other side end thereof, which is used for opening and closing of the transparent body.

Figure 12:
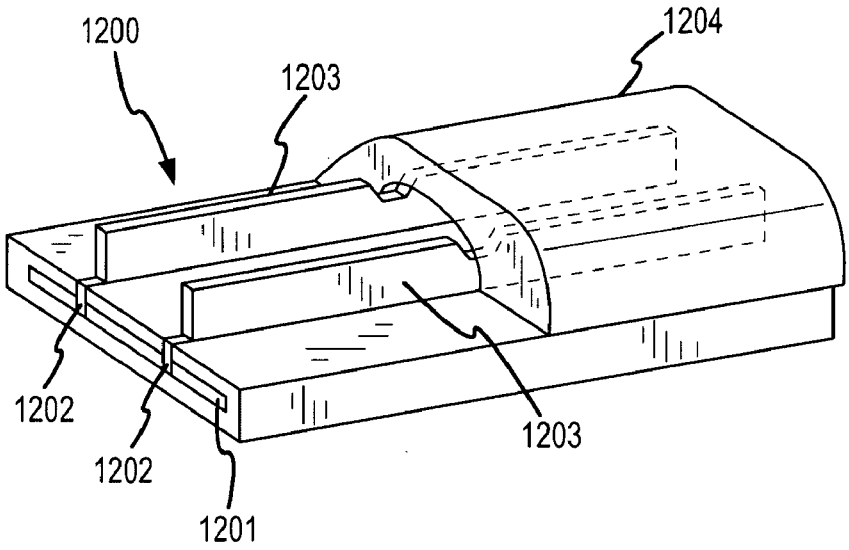
FIG. 12 is a view showing an example of the overall bed properly changed in form.

FIG. 12 is a perspective view showing the example of the upper half body supporting bed portion. In the example shown in FIG. 12, rails 1201 are installed respectively on front and rear sides of a bed 1200 across the width thereof, and sliders 1202 are slidably disposed on the respective rails 1201. Body supporting frames 1203 are mounted on the sliders 1202, while an upper washer 1204 is mounted on the bed 200.

Figure 13:
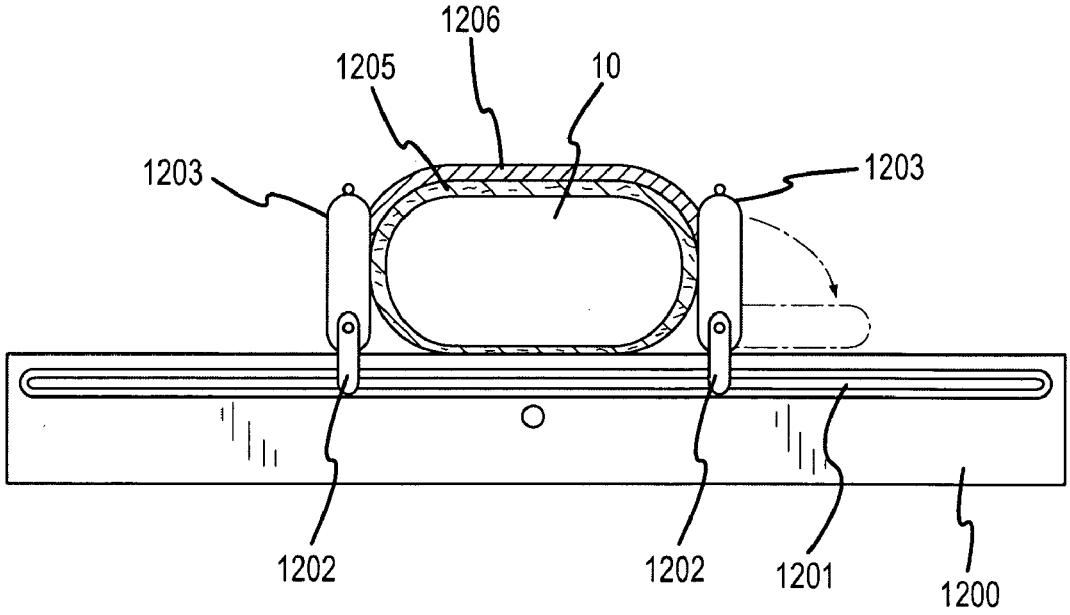
FIG. 13 is a view showing an example of using a body support frame.

FIG. 13 is a view for describing how the body supporting frames 1203 are used. As shown in FIG. 13, the body supporting frames 1203 are slid to contact the user 10 sufficiently. As mentioned above, the body supporting frames 1203 sufficiently contact the user 10 so as to firmly support the user 10 when the bed 1200 is inclined, in order to help the user turn on his or her side while in bed. In FIG. 13, numeral 1205 indicates a blanket and numeral 1206 indicates a body supporting belt.

Figure 14:
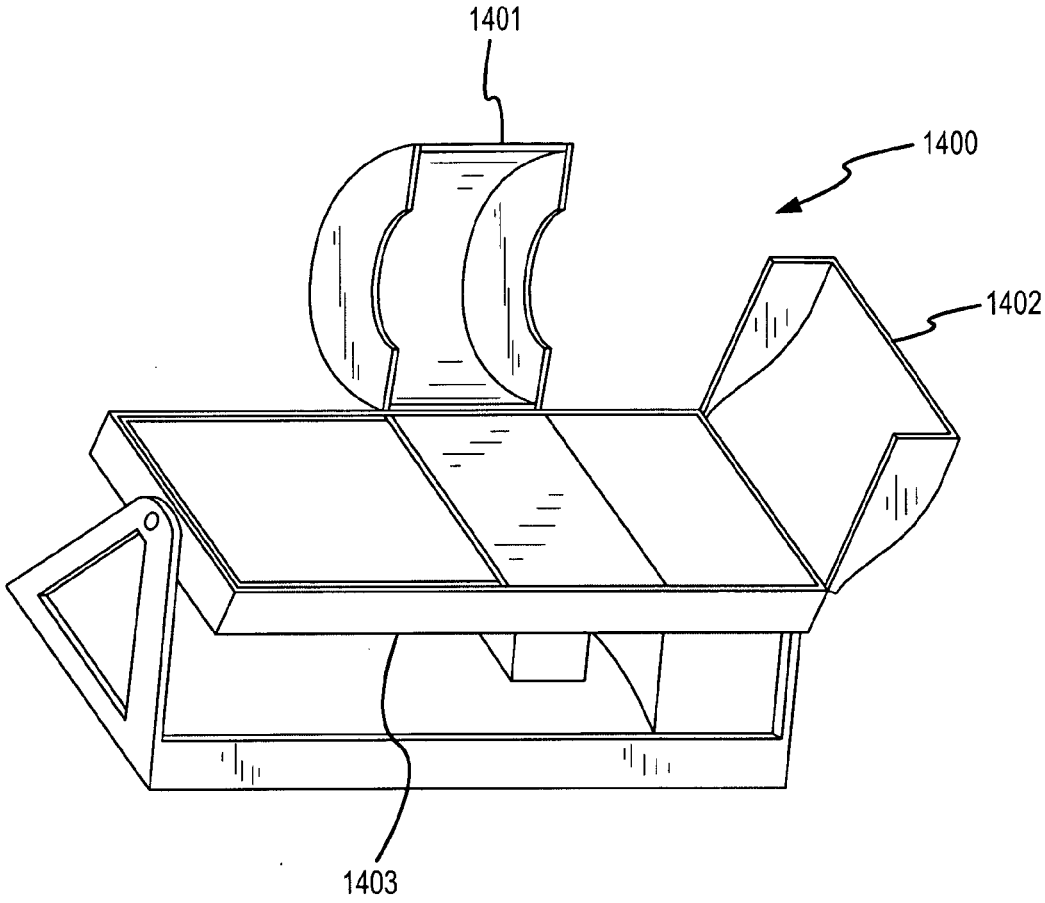
FIG. 14 is a perspective view showing another example of the upper lid body portion properly changed in form.

FIG. 14 is a perspective view showing another arrangement of the upper lid body 22. An upper lid body 1400 is constituted of first and second upper lid bodies 1401 and 1403, which are openably mounted separately on side parts of a bed 1403. In this manner, division of the upper lid body into the first and second upper lid bodies 1401 and 1403 simplifies the handling thereof, as compared with an integral formation.

Figure 15:
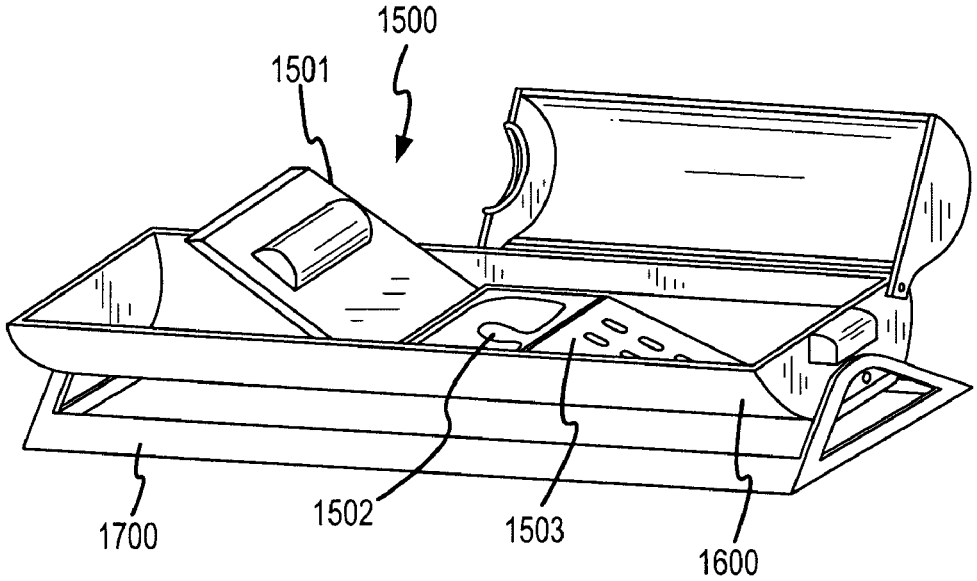
FIG. 15 is a perspective view showing an example of the medical sanitary system bed made up of a convenient bed type, which is housed in a water tank.
Figure 16:
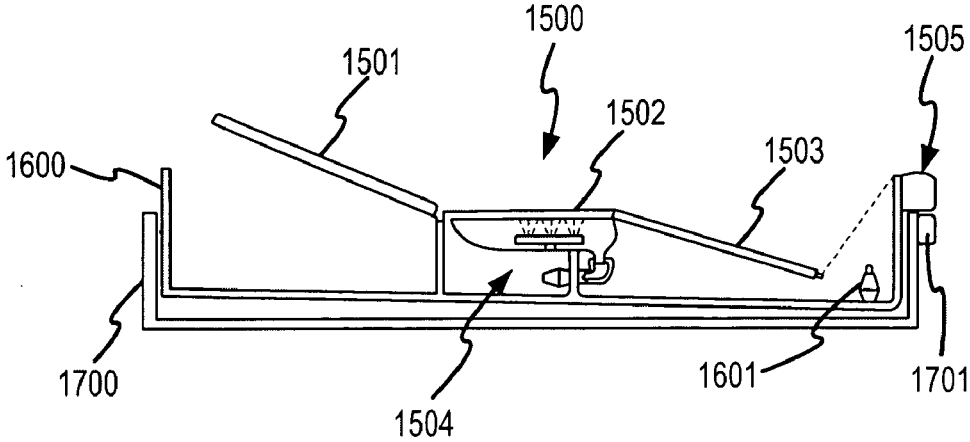
FIG. 16 is a view showing an example of the convenient bed type housed in the water tank.

With reference to FIGS. 15 and 16, an example of a convenient type of bed shall be described. As illustrated, in the present example, the convenient bed type 1500 is housed in a water tank 1600. The convenient bed type 1500 comprises a bed 1501 for supporting the upper half body, a bed 1502 for supporting the waist portion of the body, and a bed 1503 for supporting the user's legs, each of which are foldable freely individually.

The water tank 1600 is rotatably supported on a support base 1700, and a turning mechanism 1701 (a motor 1701 is shown representing the turning mechanism in FIG. 16) is actuated to turn the water tank so as to be positionable at arbitrary angles. A lower flush toilet 1504, as mentioned above, is disposed below the bed 1502 that supports the waist portion of the user. The bed 1503 can be set at arbitrary angles using a hoisting mechanism 1505. In addition, an underwater pump 1601 is arranged within the water tank 1600, to discharge the sewage accumulated in the water tank 1600 to the outside.

In the medical sanitary multifunctional system bed of the present invention, as previously stated, a unique structure is provided, whereby various functions may be added separately onto the body of the bed. Therefore, the user can select necessary functions, in a modular fashion, for constructing the bed, in which functions truly required are arranged systematically. Such a structure eliminates the disadvantage in which the user must pay extra payments at unreasonably higher prices, as a result of including functions which are not actually necessary.

For example, the lower flush toilet may be attached under the bed, for use when the user becomes too feeble to walk to the toilet from the bed. In contrast, users who are able to walk to the toilet can obtain system beds at a lower price, which can be lowered by a cost equivalent to that of the lower flush toilet 400. In order to be attached in a modular fashion, the flush toilet is constructed detachably underneath the bed, hence offering the advantage of facilitating cleaning and maintenance thereof.

In addition to the flush toilet underneath the bed, additional functions, which may be made available as needed according to the present invention, are an upper body washer, a bed rotation aid for preventing possible bedsores, shower and bath sets, and the like. The system bed, if provided integrally with all of these functions, would be very costly. However, by selectively adding necessary functions, as in the case of the system bed in accordance with the present embodiments, it is possible to obtain a system bed having necessary functions at reduced cost.

FIGS. 17(A) through 17(F) illustrate an example of the present invention, which enables taking a bath, and how to take a bath. Description is made in order from FIG. 17(A) to FIG. 17(F). Numeral 53 in FIG. 17(A) indicates a cushion part of the bed, on the outside of which a frame (not illustrated) made from wood, aluminum, steel or the like, is applied. The cushion parts of the bed are turned with a hinge 52, and are automatically controlled thereby. Rails, indicated at 51, are arranged side by side in parallel on the front and rear sides of the frame of the rotary bed, and a gear and lock mechanism are provided within a rotation fixing device, indicated at 50.

Figures 17A, 17B, 17C, 17D, 17E, 17F:
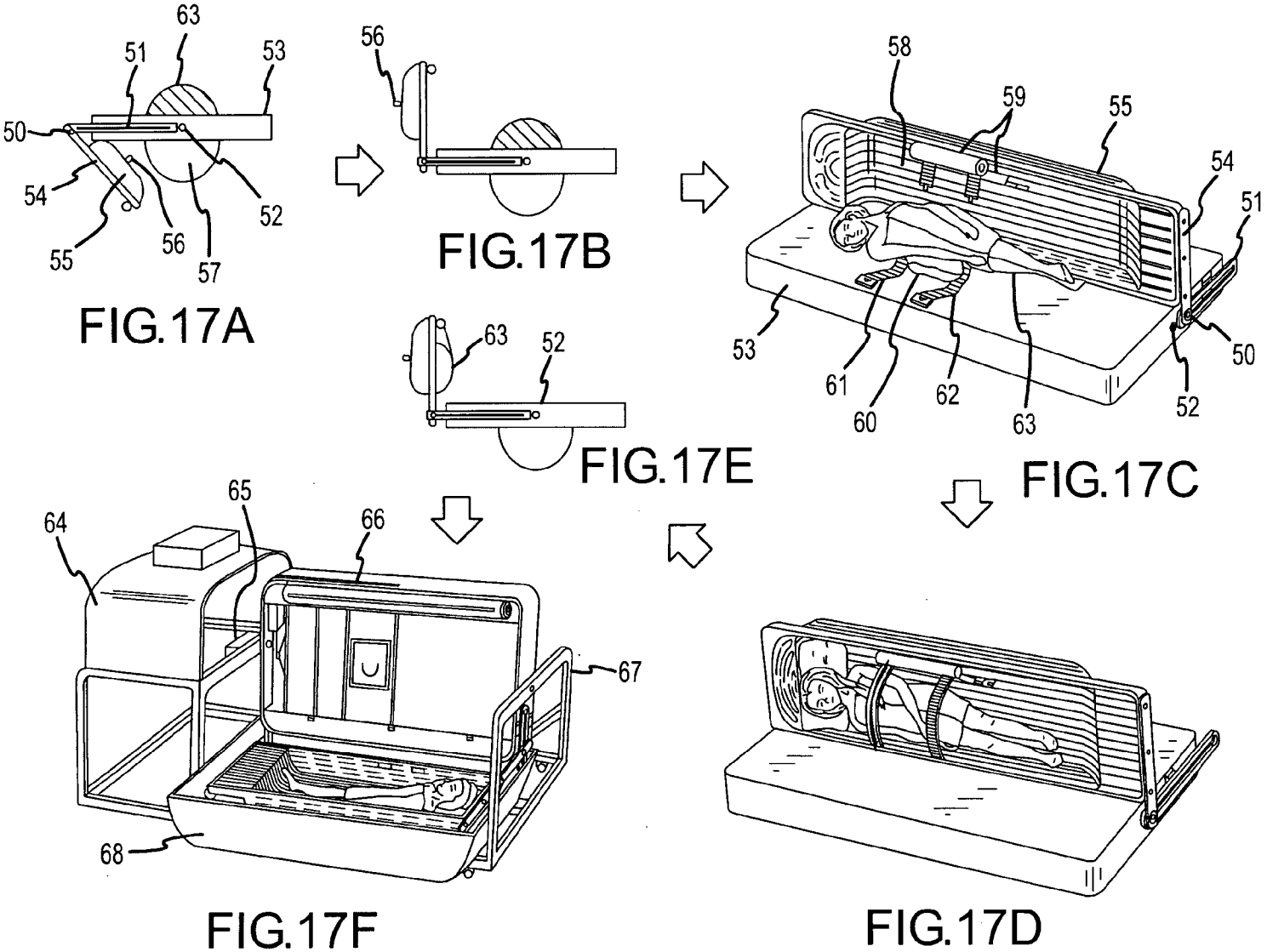
FIG. 17(F) is a perspective view of the medical sanitary multifunctional system bed, illustrating an embodiment according to the present invention.
FIGS. 17(A), 17(B) and 17(E) are partial views, illustrating states in which the body of the bed and a tray for transferring a patient or the like are transferred relatively, according the present invention.
FIGS. 17(C) and 17(D) are further partial views, illustrating states in which the body of the bed and the tray for transferring a patient or the like are transferred relatively, according to the present invention.
Figure 18A:
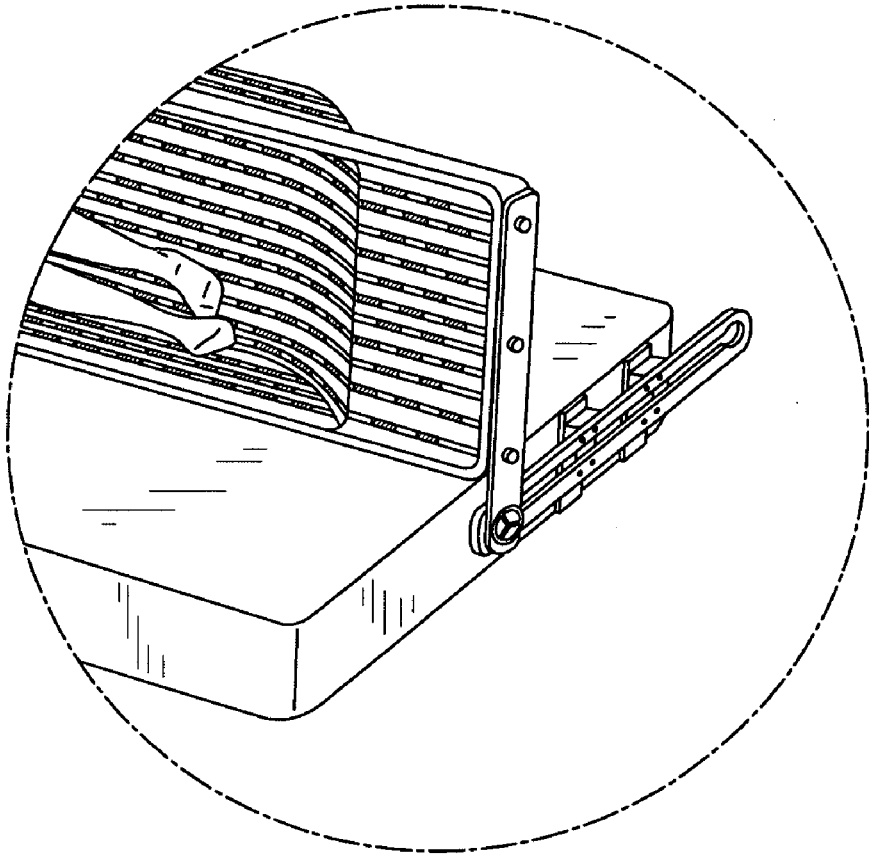
FIG. 18(A) is an enlarged view of the right side of the view shown in FIG. 17 (C).
Figure 18B:
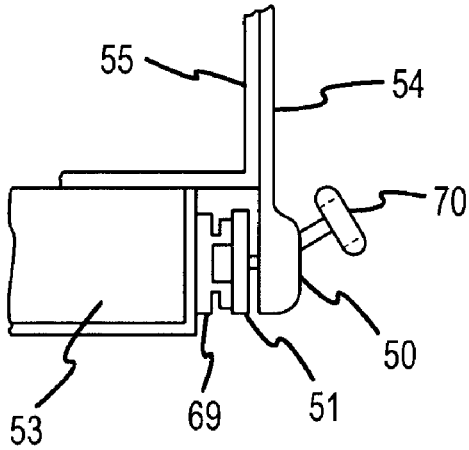
FIG. 18(B) is a view for describing the front of the view shown in FIG. 18 (A).
Figure 19:
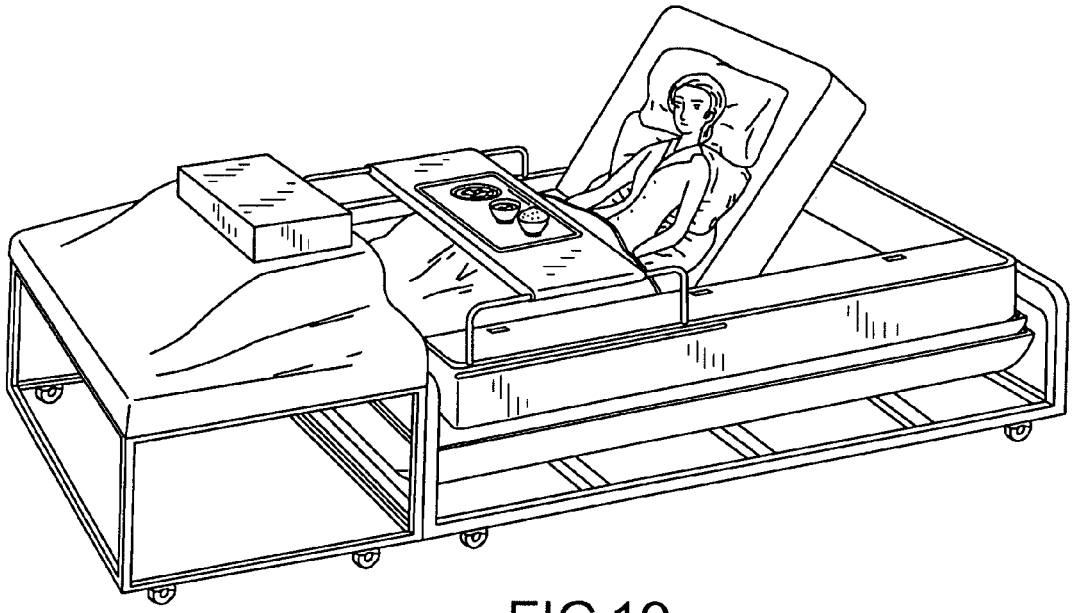
FIG. 19 is a perspective view illustrating a state in which a patient is given a meal, wherein a mobile type upper washer is shown on the left.
Figure 20:
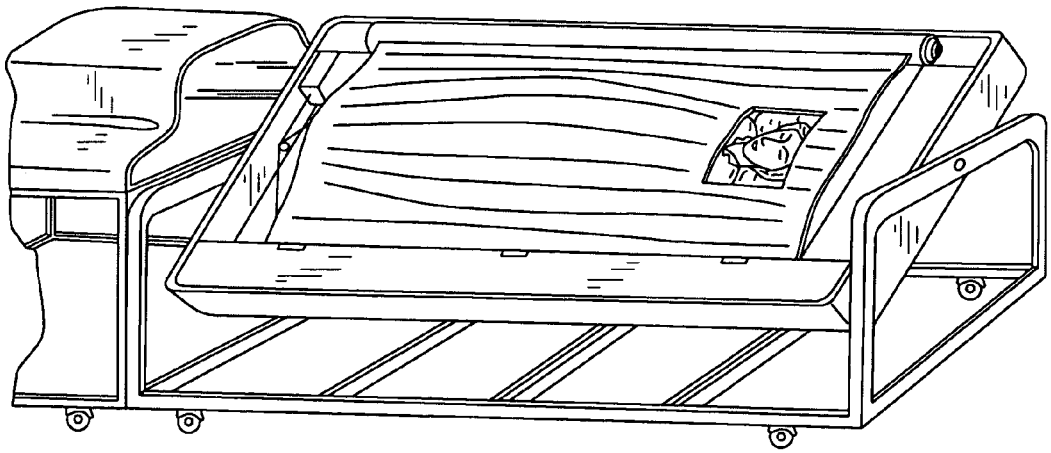
FIG. 20 is a perspective view illustrating the state in which a patient is sleeping, in which a rotation controller is shown in operation for preventing bed sores.

A bath tray, indicated at 55, is normally folded under the body of the bed, so as not to disturb use of the body 53 portion of the bed, and is moved only when the patient requires bathing. The bath tray 55, as shown in FIG. 17(A), is moved to the position indicated in FIG. 17(B) when turned by 225 degrees with the rotation fixing device 50. The bath tray, at the position as indicated in FIG. 17(B), is then pushed manually by an attending person using a knob, indicated at 56, whereby the bath tray is shifted to the position indicated in FIG. 17(C). The rotation fixing device is locked in place, and a cushion, such as a Japanese style cushion, is placed beneath the patient 63, while the patient is lifted slightly so that belts 61 and 62 may be passed around the patient, and then the body of the patient is fixed in place using a belt winding device, indicated at 59, which may be operable manually or electrically.

When the rotation fixing device 50 in FIG. 17(D) is unlocked, and the bath tray is transferred toward the ends of the rails, the user's body and the bath tray reach the position indicated in FIG. 17(E). As the bed is turned slowly by 90 degrees with the bed rotation controller 65 shown in FIG. 17(F), the bath tray enters into the bath tub and hot water flows thereinto through numerous holes (50 or the like), so as to cover the bath tray. Then, the belts are taken off of the patient, so that the patient may freely take a bath. Thus, the present invention facilitates care of the patient before and during bathing. After completing the bath, the patient is transferred back onto the upper portion of the bed, by following a reverse procedure to the one mentioned above.

According to the present invention, the body of the bed is constructed of a lower half body supporting bed portion for supporting the lower half body of the user, a waist-bed portion for supporting the central part of the user, and an upper half body supporting portion for supporting the upper half body of the user. The bed is rotatably mounted on the bed base while being arranged to allow mounting of the upper hot water washer at an upper portion of the bed, together with mounting of the lower hot water washer and the lower flush toilet underneath the waist-bed portion, and mounting of the upper half support body, which is used for changing the position of the user on the upper half body supporting portion of the bed. Accordingly, it possible to provide a bed with functions tailored to the actual needs of the user. As a result, a medical sanitary multifunctional system bed, having only those functions that are required by the user can be supplied at lower cost. The optional addition of the necessary functions in a modular fashion allows the construction of medical sanitary multifunctional system beds, which match the clinical conditions of the user. Such features enable nursing beds to be provided, which have the necessary minimal functions required for proper patient care, and which are sufficient for nursing of patients and elderly persons who are unavoidably confined to bed. Furthermore, according to the present invention, a cord heater is wound around the hot water supply hose that supplies hot water stored in the water tank, to avoid supplying hot water which has become cooled to the user during initial operation, thereby allowing the user to be supplied with comfortable hot water constantly.

What is claimed is:

1. A medical sanitary multifunctional system bed, comprising:

a lower half body supporting bed portion for supporting a lower half body of a user;

a waist bed portion for supporting a central part of the user; and an upper half body supporting bed portion for supporting an upper half body of the user, wherein said lower half body supporting bed portion, said waist bed portion and said upper half body supporting bed portion are rotatably mounted collectively on a bed base, said system bed further comprising:

an upper hot water washer mounted proximate to and above said lower half body supporting bed portion;

a lower hot water washer and a lower flush toilet disposed under said waist bed portion; and upper half body supporting bodies, which are used for adjusting the position of the user on said upper half body supporting bed portion.

2. The medical sanitary multifunctional system bed according to claim 1, further comprising cushions disposed on said waist bed portion, at least one of said cushions being removable so that said lower hot water washer and said lower flush toilet disposed under said waist bed portion are made accessible to the user, for allowing use of said lower flush toilet.

3. The medical sanitary multifunctional system bed as claimed in claim 2, wherein said lower flush toilet includes a crushing means, said crushing means comprising a crushing cutter and a motor, which function to crush and discharge excrement expelled by the user.

4. The medical sanitary multifunctional system bed according to claim 1, wherein said system bed is rotatably mounted on said bed base through a rotating support shaft, said system bed being rotatable by a specified angle and in a specified direction through operation of a rotation controller for controlling rotation of said rotating support shaft.

5. A medical sanitary multifunctional system bed as claimed in claim 2, further comprising:

a water tank for storing hot water, which is supplied to said upper hot water washer and said lower hot water washer; and a cord heater which is wound around a hose connected to said water tank, wherein said hose supplies said hot water stored in said water tank to said upper hot water washer and said lower hot water washer.

6. The medical sanitary multifunctional system bed as claimed in claim 1, further comprising an external bathtub rotatably disposed proximate to a cushion of said system bed, said external bathtub including a bath tray into which said user is transferred from said cushion of said bed, said bath tray further being movable parallel to said cushion from a substantially central part to a side end part of said cushion.

* * * * *